US009779656B2

(12) United States Patent
Lin et al.

(10) Patent No.: US 9,779,656 B2
(45) Date of Patent: Oct. 3, 2017

(54) PIXEL DRIVING METHOD OF A DISPLAY PANEL AND DISPLAY PANEL THEREOF

(71) Applicant: AU Optronics Corp., Hsin-Chu (TW)

(72) Inventors: Chun-Chieh Lin, Hsin-Chu (TW); Chih-Cheng Chen, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 739 days.

(21) Appl. No.: 14/296,462

(22) Filed: Jun. 5, 2014

(65) Prior Publication Data

US 2014/0361964 A1 Dec. 11, 2014

(30) Foreign Application Priority Data

Jun. 6, 2013 (TW) ..... 102120122 A

(51) Int. Cl.

| | |
|---|---|
| ***G09G 3/30*** | (2006.01) |
| ***G09G 3/3233*** | (2016.01) |
| ***G09G 3/12*** | (2006.01) |

(52) U.S. Cl.

CPC ..... *G09G 3/3233* (2013.01); *G09G 3/12* (2013.01); *G09G 3/30* (2013.01); *G09G 2300/0842* (2013.01); *G09G 2320/0233* (2013.01); *G09G 2320/0295* (2013.01); *G09G 2320/043* (2013.01)

(58) Field of Classification Search

CPC ..... G09G 3/3233; G09G 2320/0295; G09G 2320/0233; G09G 2300/0842; G09G 2320/043; G09G 3/12; G09G 3/30

See application file for complete search history.

(56) References Cited

U.S. PATENT DOCUMENTS

| | | | | |
|---|---|---|---|---|
| 8,115,707 | B2 | 2/2012 | Nathan | |
| 8,284,126 | B2 | 10/2012 | Kwon | |
| 2002/0047839 | A1* | 4/2002 | Kasai | G09G 3/3233 345/211 |
| 2007/0063993 | A1* | 3/2007 | Shishido | G09G 3/3241 345/175 |
| 2007/0195020 | A1 | 8/2007 | Nathan | |

(Continued)

FOREIGN PATENT DOCUMENTS

| | | |
|---|---|---|
| TW | 201137830 | 11/2011 |
| TW | 201216244 | 4/2012 |
| TW | 201222511 | 6/2012 |

*Primary Examiner* — Nicholas Lee
*Assistant Examiner* — Gerald Oliver
(74) *Attorney, Agent, or Firm* — Locke Lord LLP; Tim Tingkang Xia, Esq.

(57) ABSTRACT

A pixel driving method of a display panel is disclosed. The display panel includes a plurality of scan lines, data lines and pixels. Each of the pixel includes a first transistor with a first end coupled to the data line, and a gate end coupled to the scan line, a second transistor with a first end selectively coupled to a voltage source or current source, and a gate end coupled to a second end of the first transistor, and a light-emitting unit with a first end coupled to a second end of the second transistor. The method includes turning on the first transistors of the pixels; coupling the data lines and first ends of the second transistors to the current source; reading voltage levels of gate ends of the second transistors; and providing corresponding data voltages to the pixels according to voltage levels of gate ends of the second transistors.

20 Claims, 5 Drawing Sheets

(56) References Cited

U.S. PATENT DOCUMENTS

| | | | | |
|---|---|---|---|---|
| 2011/0254871 | A1 | 10/2011 | Yoo | |
| 2012/0086694 | A1 | 4/2012 | Tseng | |
| 2015/0235595 | A1* | 8/2015 | Sugihara | G09G 3/3233 345/691 |

* cited by examiner

PIXEL DRIVING METHOD OF A DISPLAY PANEL AND DISPLAY PANEL THEREOF

BACKGROUND OF THE INVENTION

1. Field of the Invention

The present invention relates to a pixel driving method of a display panel and a display panel, and more particularly, to a pixel driving method of a display panel and a display panel capable of compensating differences of electrical characteristics.

2. Description of the Prior Art

An organic light emitting diode display panel is a display device utilizing organic light emitting diode pixels to emit light for displaying images. Brightness of an organic light emitting diode is directly proportional to amount of current flowing through the organic light emitting diode. Generally, in order to control the amount of the current flowing through the organic light emitting diode, the organic light emitting diode pixel comprises a current control switch for controlling the amount of the current flowing through the organic light emitting diode according to a display voltage at a gate end of the current control switch, so as to further control the brightness of the organic light emitting diode.

However, threshold voltage of the current control switch of each organic light emitting diode pixel may be different. Moreover, voltage across the organic light emitting diode may have variation due to aging of the organic light emitting diode. The above differences of electrical characteristics of the current control switch and the organic light emitting diode may affect the brightness of the organic light emitting diode. The organic light emitting diode display panel of the prior art is easy to be affected by the differences of electrical characteristics of the current control switch and the organic light emitting diode, such that image quality gets worse.

SUMMARY OF THE INVENTION

The embodiment of present invention provides a pixel driving method of a display panel, wherein the display panel comprises a plurality of scan lines, a plurality of data lines, and a plurality of pixels. Each of the pixels comprises a first transistor, a second transistor, and a light emitting unit. A first end of the first transistor is coupled to a data line of the plurality of data lines. A gate end of the first transistor is coupled to a scan line of the plurality of scan lines. A first end of the second transistor is selectively coupled to a voltage source or a current source. A gate end of the second transistor is coupled to a second end of the first transistor. A first end of the light emitting unit is coupled to a second end of the second transistor. A third transistor is arranged between the second transistors of each two columns of the pixels, and configured to electrically connect or disconnect the first ends of the second transistors of the two columns of the pixels, the pixel driving method comprises turning on the first transistors of the pixels; coupling the data lines and the first ends of the second transistors to the current source; reading voltage levels of the gate ends of the second transistors; providing corresponding data voltages to the pixels through the data lines according to the voltage levels of the gate ends of the second transistors; coupling the first ends of the second transistors to the voltage source for allowing the pixels to receive currents from the voltage source according to the corresponding data voltages; and before reading the voltage levels of the gate ends of the second transistors, turning off the third transistor electrically connected between the first ends of the second transistors of the two columns of the pixels, and after reading the voltage levels of the gate ends of the second transistors, turning on the third transistor electrically connected between the first ends of the second transistors of the two columns of the pixels.

The other embodiment of present invention further provides a display panel comprising a plurality of scan lines, a plurality of data lines, a plurality of pixels, a voltage reading unit, a display voltage adjusting unit, and a plurality of third transistors. Each of the pixels comprises a first transistor, a second transistor, and a light emitting unit. A first end of the first transistor is coupled to a data line of the plurality of data lines, and a gate end of the first transistor is coupled to a scan line of the plurality of scan lines. A first end of the second transistor is selectively coupled to a voltage source or a current source, and a gate end of the second transistor is coupled to a second end of the first transistor. A first end of the light emitting unit is coupled to a second end of the second transistor. The voltage reading unit is coupled to the plurality of data lines, and configured to read voltage levels of the gate ends of the second transistors when the first transistors of the pixels are turned on, and the data lines and the first ends of the second transistors are coupled to the current source. The display voltage adjusting unit is configured to provide corresponding data voltages to the pixels through the data lines according to the voltage levels of the gate ends of the second transistors, in order to allow the pixels to receive currents from the voltage source according to the corresponding data voltages when the first ends of the second transistors are coupled to the voltage source. Each of the third transistors is electrically connected between the second transistors of each two columns of the pixels, and configured to electrically connect or disconnect the first ends of the second transistors of the two columns of the pixels.

The pixel driving method of a display panel and the display panel of the present invention can effectively compensate differences of electrical characteristics of the current control switch and the organic light emitting diode. Therefore, image quality of the display panel of the present invention is not easy to be affected by the differences of electrical characteristics of the current control switch and the organic light emitting diode, so as to improve image quality.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
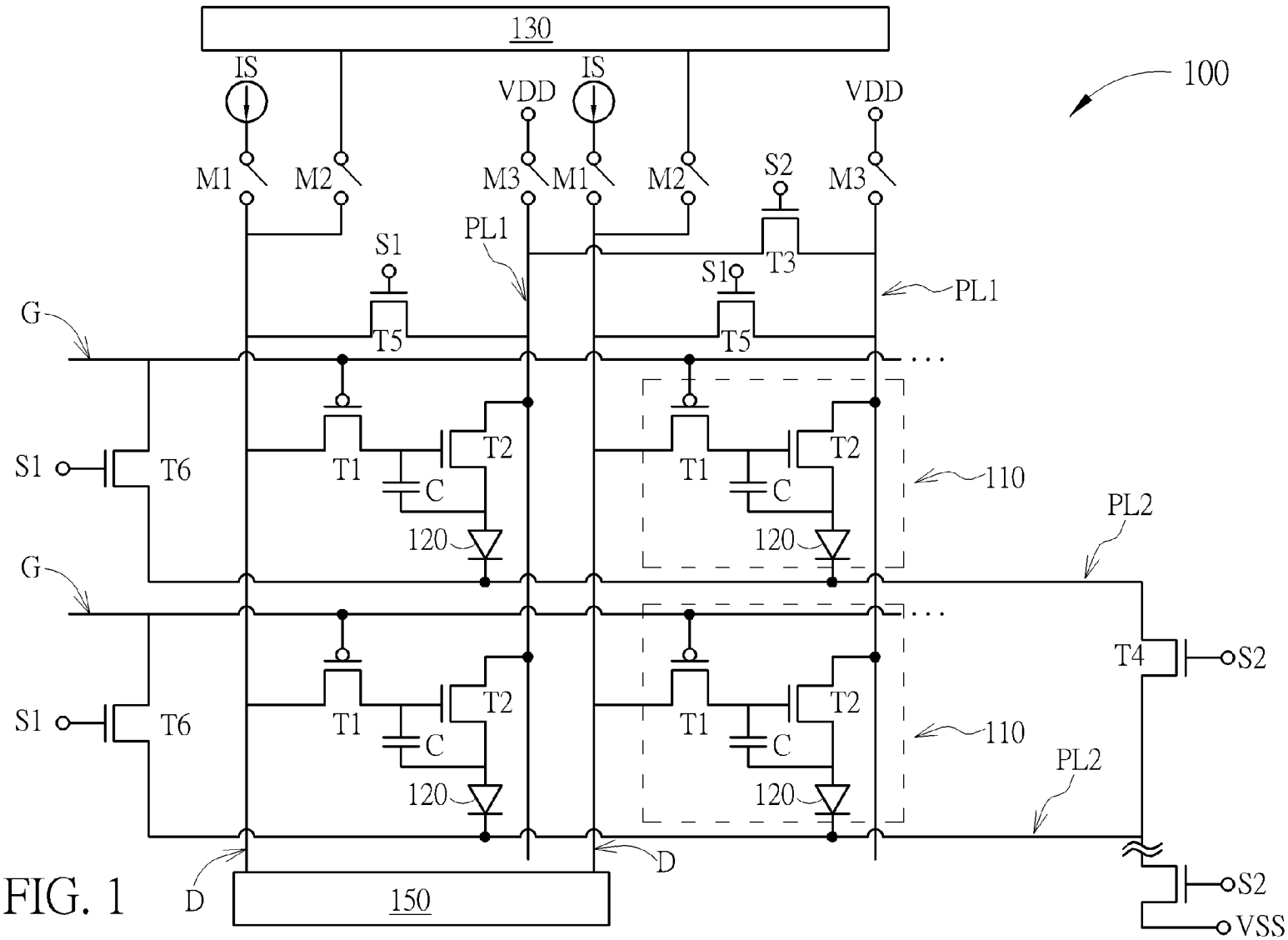
FIG. 1 is a diagram showing a first embodiment of a display panel of the present invention.

Please refer to FIG. 1. FIG. 1 is a diagram showing a first embodiment of a display panel of the present invention. As shown in FIG. 1, the display panel 100 of the present invention comprises a plurality of scan lines G, a plurality of data lines D, a plurality of pixels 110, a voltage reading unit 150, and a display voltage adjusting unit 130. Each of the pixels 110 comprises a first transistor T1, a second transistor T2, and a light emitting unit 120. A first end of the first transistor T1 is coupled to a corresponding data line D, and a gate end of the first transistor T1 is coupled to a corresponding scan line G. A first end of the second transistor T2 is selectively coupled to a high level voltage source VDD or a current source IS. A gate end of the second transistor T2 is coupled to a second end of the first transistor T1. A first end of the light emitting unit 120 is coupled to a second end of the second transistor T2.

The voltage reading unit 150 is coupled to the plurality of data lines D, and configured to read voltage levels of the gate ends of the second transistors T2 of the pixels during a detection state. The display voltage adjusting unit 130 is configured to compensate display voltages of the pixels 110 by providing corresponding data voltages to the pixels. Each of the pixels further comprises a capacitor C configured to store the corresponding data voltage. In the first embodiment of the present invention, the first transistor T1 is a P-type transistor, and the second transistor T2 is an N-type transistor.

In addition, the display panel of the present invention further comprises a plurality of third transistors T3, fourth transistors T4, fifth transistors T5 and sixth transistors T6. The third transistor T3 is coupled between the first ends of the second transistors T2 of two columns of the pixels 110, and configured to electrically connect or disconnect the first ends of the second transistors T2 of the two columns of the pixels 110. The fourth transistor T4 is coupled between second ends of the light emitting units 120 of two rows of the pixels 110, and configured to electrically connect or disconnect the second ends of the light emitting units 120 of the two rows of the pixels 110. The fifth transistor T5 is coupled between the first ends of the second transistors T2 of a column of the pixels 110 and a corresponding data line D, and configured to electrically connect or disconnect the first ends of the second transistors T2 of the column of the pixels 110 with the corresponding data line D. The sixth transistor T6 is coupled between the second ends of the light emitting units 120 of a row of the pixels 110 and a corresponding scan line G, and configured to electrically connect or disconnect the second ends of the light emitting units 120 of the row of the pixels 110 with the corresponding scan line G.

Figure 2:
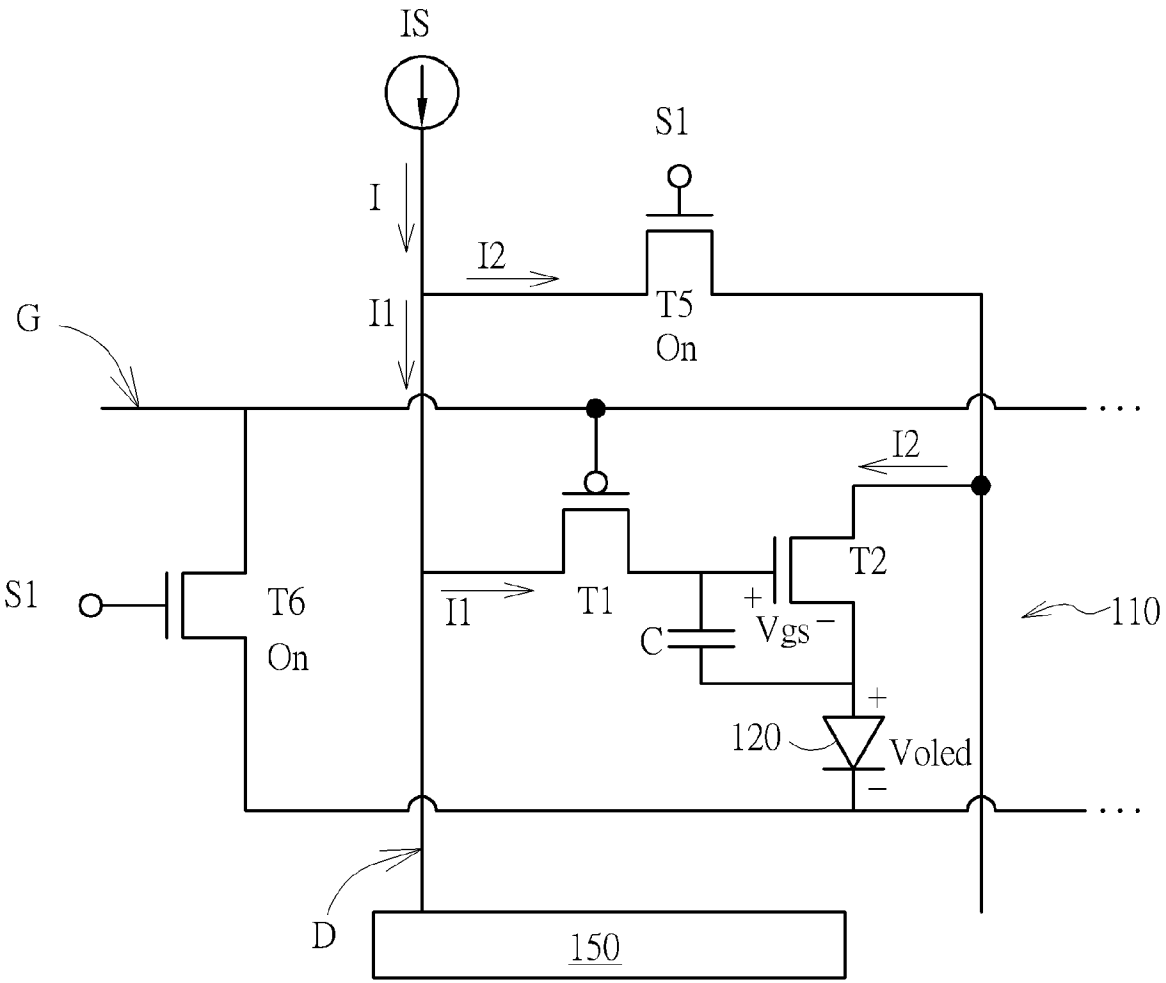
FIG. 2 is a diagram showing the pixel of the display panel of FIG. 1 in a detection state.

Please refer to FIG. 2, and refer to FIG. 1 as well. FIG. 2 is a diagram showing the pixel of the display panel of FIG. 1 in a detection state. When the display panel 100 is in the detection state, the display panel 100 sequentially turns on the first transistors T1 of each row of the pixels 110 via the scan lines G. Besides, first switches M1 are in a conducting state, second switches M2 are in a non-conducting state, and third switches M3 are in a non-conducting state, such that the data lines D and the first ends of the second transistors T2 of the pixels 110 are coupled to the current source IS. When the first transistors T1 of a first row of pixels are turned on, the first transistors T1 of other rows of pixels are turned off, in order to ensure that current provided by the current source IS only flows to the first row of the pixels. In addition, all of the fifth transistors T5 and the sixth transistors T6 are turned on by a first control signal S1, and all of the third transistors T3 and the fourth transistors T4 are turned off by a second control signal S2. Therefore, a first power line PL1 of each column of the pixels is disconnected from other first power lines PL1, and a second power line PL2 of each row of the pixels is disconnected from other second power lines PL2.

Moreover, at the beginning, a current I1 flowing through the turned-on first transistor T1 is close to the current I provided by the current source IS, and the current I1 further flows to the capacitor C for charging the capacitor C, so as to turn on the second transistor T2. A current I2 flowing through the second transistor T2 is much smaller than the current I1, and the current I2 further flows to light emitting diode 120. Thereafter, the current I2 flowing through the second transistor T2 is gradually increased. When the current I2 flowing through the second transistor T2 is approximately equal to or equal to the current I provided by the current source IS, the voltage reading unit 150 reads voltage levels of the gate ends of the second transistors T2 of the first row of the pixels. In addition, the first transistors of a second row and subsequent rows of the pixels can be sequentially turned on via the scan lines G, so as to sequentially read voltage levels of the gate ends of the second transistors T2 of each row of the pixels.

Since the voltage level of the gate end of the second transistor T2 corresponds to a summation of a cross-voltage Voled of the light emitting unit 120 and a voltage difference Vgs between the gate end and the source end of the second transistor T2 under a condition of the current with a same level flowing through the second transistor T2, the display voltage adjusting unit 130 can obtain a corresponding compensation voltage of the pixel according to the voltage level of the gate end of the second transistor T2.

For example, the display voltage adjusting unit 130 can obtain an average value of the voltage levels of the gate ends of all the second transistors T2, and then subtract the average value from the voltage level of the gate end of each second transistor T2 to obtain the corresponding compensation voltage of the pixel. Or, the display voltage adjusting unit 130 can add the average value to a predetermined value for obtaining a reference value, and then subtract the reference value from the voltage level of the gate end of each second transistor T2 to obtain the corresponding compensation voltage of the pixel.

After obtaining the compensation voltage of each of the pixels, the display voltage adjusting unit 130 can obtain a corresponding data voltage of the pixel by adding the corresponding compensation voltage to an original display voltage of the pixel. The display voltage adjusting unit 130 then further provides the corresponding data voltage to the pixel 110 via the data line D for displaying an image. Since the corresponding data voltage of each pixel is obtained by adding the corresponding compensation voltage to the original display voltage of the pixel, and the compensation voltage is obtained according to the average value of the voltage levels of the gate ends of all the second transistors T2 during the detection state, thus the corresponding data voltage of each pixel 110 already excludes the factor of variations in the cross-voltage Voled of the light emitting unit 120 and the threshold voltage of the second transistor T2. Therefore, each of the pixels can display the correct image according to the corresponding data voltage.

For example, under the condition of the current with the same level (such as 0.1 uA) flowing through the second transistor T2, with assuming the cross-voltages Voled of the light emitting units 120 of three pixels respectively are 2V, 2V and 3V, the threshold voltages of the second transistors T2 of the three pixels respectively are 1V, 2V and 2V, and a low level voltage source is −1V, it is only possible to know the voltage levels of the gate ends of the second transistors T2 from the voltage reading unit 150 to respectively be 4V, 5V and 6V, and obtain the average value which is equal to 5V. Thereafter, the average value is respectively subtracted from the voltage levels of the gate ends of the second transistors T2 to obtain the corresponding compensation voltages of the three pixels, which respectively are −1V, 0V and 1V. If the original display voltages of the three pixels are all 8V for displaying images in a same brightness level, under a situation without compensating the original display voltages, the voltage differences by subtracting the corresponding cross-voltages Voled of the light emitting units 120 and the threshold voltages of the second transistors from the original display voltages of the three pixels respectively are 5V, 4V and 3V, that is to say, brightness levels of the three pixels are different due to the variations in the cross-voltages Voled of the light emitting units 120 and the threshold voltages of the second transistors T2. Under a situation with compensating the original display voltages, the compensated data voltages of the three pixels respectively are 7V, 8V and 9V. And voltage differences by subtracting the corresponding cross-voltages Voled of the light emitting units 120 and the threshold voltages of the second transistors from the compensated data voltages of the three pixels respectively are all equal to 4V, that is to say, voltage differences between the gate ends and the source ends of the second transistors T2 of the three pixels are identical. In other words, the brightness levels of the three pixels are ideally identical after compensation.

Figure 3:
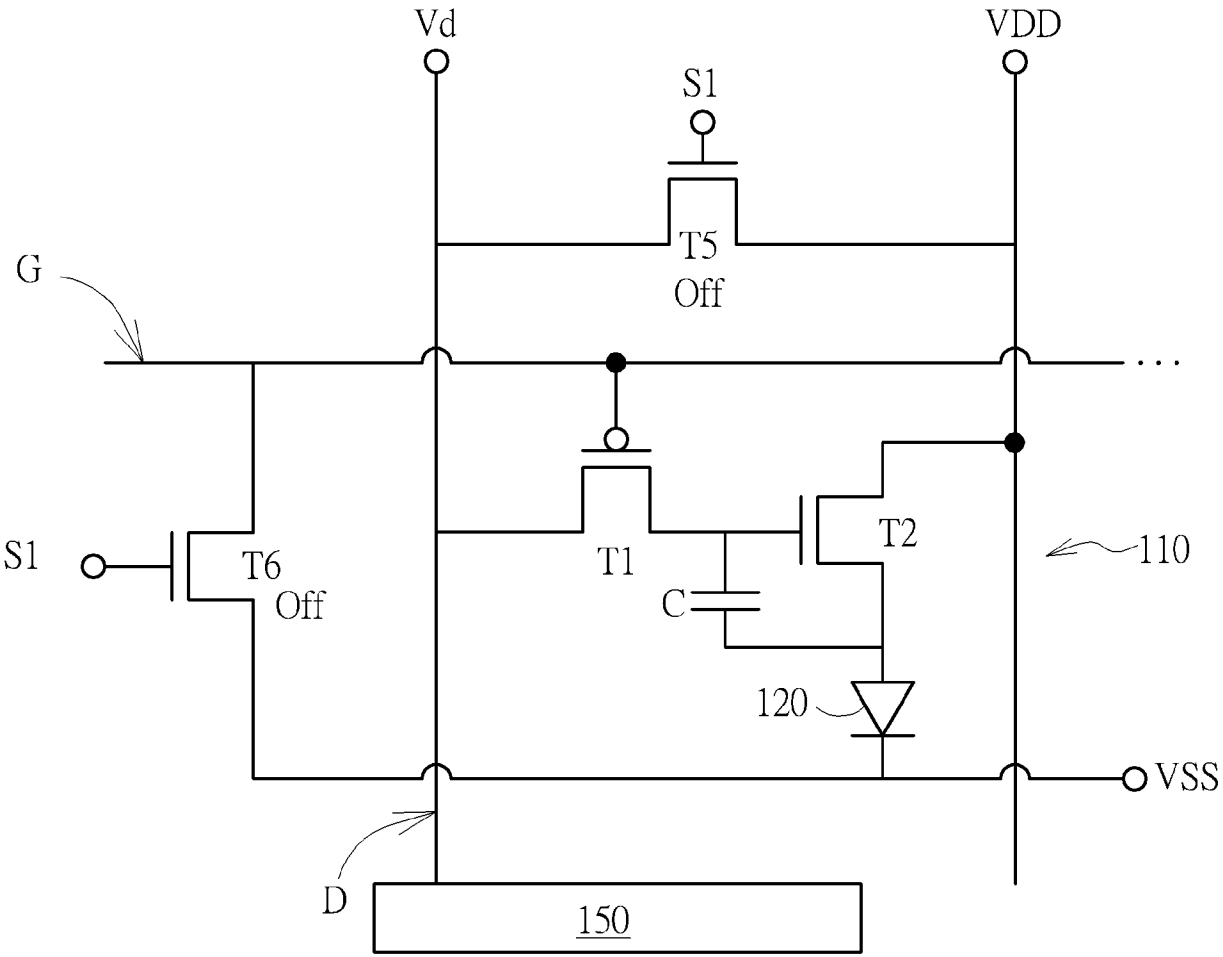
FIG. 3 is a diagram showing the pixel of the display panel of FIG. 1 in a display state.

Please refer to FIG. 3, and refer to FIG. 1 as well. FIG. 3 is a diagram showing the pixel of the display panel of FIG. 1 in a display state. When the display panel 100 is in a display state, the display panel 100 sequentially turns on the first transistors T1 of each row of the pixels 110 via the scan lines G, and the first ends of the second transistors T2 of the pixels are coupled to the high level voltage source VDD. When the first transistors T1 of a first row of pixels are turned on, the first transistors T1 of other rows of pixels are turned off. In addition, all of the third transistors T3 and the fourth transistors T4 are turned on by the second control signal S2, and all of the fifth transistors T5 and the sixth transistors T6 are turned off by the first control signal S1. When the fourth transistors T4 are turned on by the second control signal S2, the second ends of the light emitting diodes 120 are coupled to the low level voltage source VSS. Thereafter, the display voltage adjusting unit 130 provides the corresponding data voltage Vd to the first row of the pixels via the data lines D, in order to allow the first row of the pixels to receive currents from the high level voltage source VDD according to the corresponding data voltages Vd, so as to further display images. Then the display voltage adjusting unit 130 of the display panel 100 sequentially provides the corresponding data voltages to each row of the pixels via the data lines.

According to the above arrangement, the image displayed by each of the pixels is not affected by the variations in the cross-voltage Voled of the light emitting unit 120 and the threshold voltage of the second transistor. The display panel 100 of the present invention can provide the corresponding data voltages to the pixels according to voltage levels of the gate ends of the second transistors T2 read during the detection state, in order to compensate differences of electrical characteristics of the current control switch (transistor T2) and the organic light emitting diode (light emitting unit 120).

Figure 4:
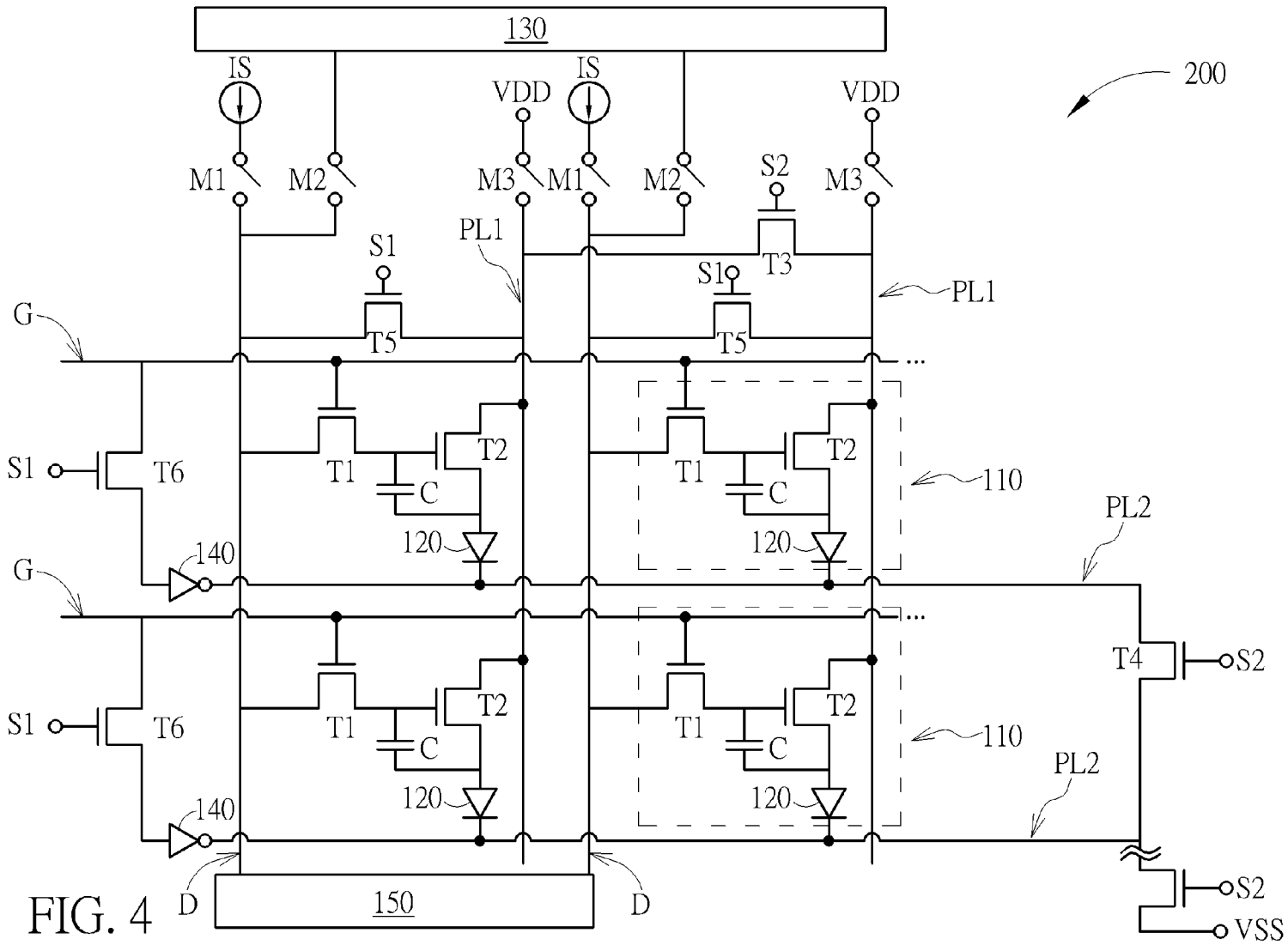
FIG. 4 is a diagram showing a second embodiment of a display panel of the present invention.

Please refer to FIG. 4. FIG. 4 is a diagram showing a second embodiment of a display panel of the present invention. In the second embodiment of the present invention, first transistors T1 and second transistors T2 of the display panel 200 are all N-type transistor, and the display panel 200 further comprises an inverter 140 coupled between the sixth transistor T6 and the second ends of a row of the light emitting units 120 of the pixels 110. Other elements and operation of the display panel 200 and are identical to those of the display panel 100 in FIG. 1, thus further explanation is not provided.

Figure 5:
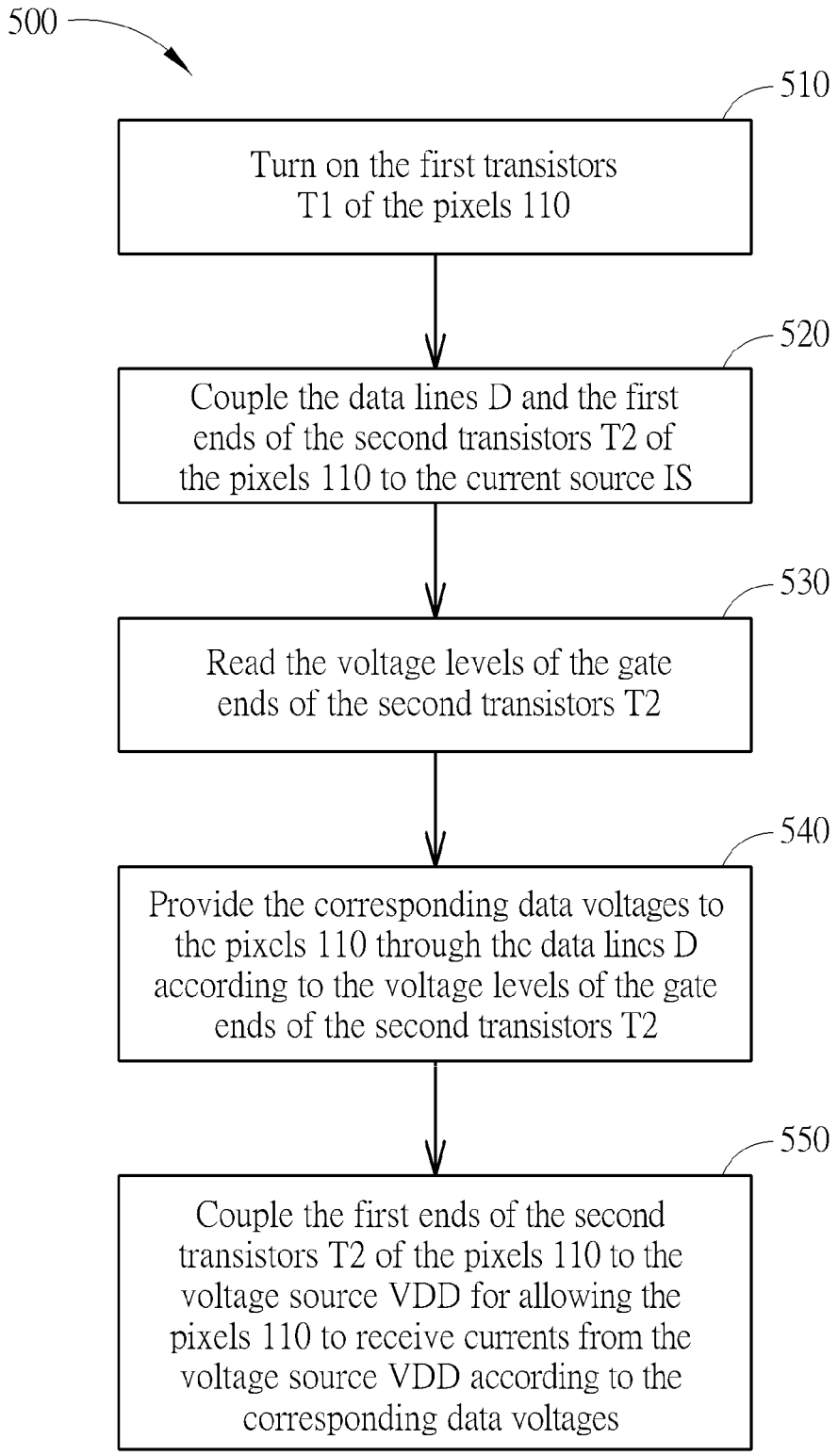
FIG. 5 is a flowchart showing a pixel driving method of the display panel of the present invention

Please refer to FIG. 5. FIG. 5 is a flowchart 500 showing the pixel driving method of the display panel of the present invention. The flowchart of the pixel driving method of the display panel of the present invention comprises the following steps:

Step 510: Turn on the first transistors T1 of the pixels 110;

Step 520: Couple the data lines D and the first ends of the second transistors T2 of the pixels 110 to the current source IS;

Step 530: Read the voltage levels of the gate ends of the second transistors T2;

Step 540: Provide the corresponding data voltages to the pixels 110 through the data lines D according to the voltage levels of the gate ends of the second transistors T2; and Step 550: Couple the first ends of the second transistors T2 of the pixels 110 to the voltage source VDD for allowing the pixels 110 to receive currents from the voltage source VDD according to the corresponding data voltages.

In addition, the step of reading the voltage levels of the gate ends of the second transistors can be performed after the display panel is turned on, or before the display panel is turned off, or performed periodically.

The pixel driving method of a display panel and the display panel of the present invention can effectively compensate differences of electrical characteristics of the current control switch and the organic light emitting diode. Therefore, image quality of the display panel of the present invention is not easy to be affected by the differences of electrical characteristics of the current control switch and the organic light emitting diode, so as to improve image quality.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A pixel driving method of a display panel, the display panel comprising a plurality of scan lines, a plurality of data lines, and a plurality of pixels, wherein each of the pixels comprises a first transistor, a second transistor, and a light emitting unit, a first end of the first transistor is coupled to one of the plurality of data lines, a gate end of the first transistor is coupled to one of the plurality of scan lines, a first end of the second transistor is selectively coupled to a voltage source or a current source, a gate end of the second transistor is coupled to a second end of the first transistor, a first end of the light emitting unit is coupled to a second end of the second transistor, a third transistor is arranged between the first ends of the second transistors of each two columns of the pixels, and configured to electrically connect or disconnect the first ends of the second transistors of the two columns of the pixels, the method comprising:

turning on the first transistors of the pixels;

coupling the data lines and the first ends of the second transistors to the current source;

reading voltage levels of the gate ends of the second transistors;

providing corresponding data voltages to the pixels through the data lines according to the voltage levels of the gate ends of the second transistors;

coupling the first ends of the second transistors to the voltage source for allowing the pixels to receive currents from the voltage source according to the corresponding data voltages; and before reading the voltage levels of the gate ends of the second transistors, turning off the third transistor electrically connected between the first ends of the second transistors of the two columns of the pixels, and after reading the voltage levels of the gate ends of the second transistors, turning on the third transistor electrically connected between the first ends of the second transistors of the two columns of the pixels.

2. The pixel driving method of claim 1, wherein reading the voltage levels of the gate ends of the second transistors, is reading the voltage levels of the gate ends of the second transistors when current flowing through the second transistor is approximately equal to current provided by the current source.

3. The pixel driving method of claim 2, wherein providing the corresponding data voltages to the pixels through the data lines according to the voltage levels of the gate ends of the second transistors comprises:

obtaining corresponding compensation voltages of the pixels according to the voltage levels of the gate ends of the second transistors; and obtaining corresponding data voltages of the pixels by performing operations according to display voltages of the pixel and the corresponding compensation voltages, and further providing the corresponding data voltages to the pixels via the data lines.

4. The pixel driving method of claim 2, wherein a fourth transistor is arranged between second ends of the light emitting units of each two rows of the pixels, and configured to electrically connect or disconnect the second ends of the light emitting units of the two rows of the pixels, the driving method further comprises:

before reading the voltage levels of the gate ends of the second transistors, turning off the fourth transistor electrically connected between the second ends of the light emitting units of the two rows of the pixels, and after reading the voltage levels of the gate ends of the second transistors, turning on the fourth transistor electrically connected between the second ends of the light emitting units of the two rows of the pixels.

5. The pixel driving method of claim 2, wherein a fifth transistor is arranged between the first ends of the second transistors of each column of the pixels and a corresponding data line, and configured to electrically connect or disconnect the first ends of the second transistors of the column of the pixels with the corresponding data line, the driving method further comprises:

before reading the voltage levels of the gate ends of the second transistors, turning on the fifth transistor electrically connected between the first ends of the second transistors of the column of the pixels and the corresponding data line, and after reading the voltage levels of the gate ends of the second transistors, turning off the fifth transistor electrically connected between the first ends of the second transistors of the column of the pixels and the corresponding data line.

6. The pixel driving method of claim 2, wherein a sixth transistor is arranged between second ends of the light emitting units of each row of the pixels and a corresponding scan line, and configured to electrically connect or disconnect the second ends of the light emitting units of the row of the pixels with the corresponding scan line, the driving method further comprises:

before reading the voltage levels of the gate ends of the second transistors, turning on the sixth transistor electrically connected between the second ends of the light emitting units of the row of the pixels and the corresponding scan line, and after reading the voltage levels of the gate ends of the second transistors, turning off the sixth transistor electrically connected between the second ends of the light emitting units of the row of the pixels and the corresponding scan line.

7. The pixel driving method of claim 1, wherein providing the corresponding data voltages to the pixels through the data lines according to the voltage levels of the gate ends of the second transistors, is providing the corresponding data voltages to the pixels through the data lines according to an average value of the voltage levels of the gate ends of the second transistors.

8. The pixel driving method of claim 7, wherein providing the corresponding data voltages to the pixels through the data lines according to the voltage levels of the gate ends of the second transistors comprises:

obtaining corresponding compensation voltages of the pixels according to the voltage levels of the gate ends of the second transistors; and obtaining corresponding data voltages of the pixels by performing operations according to display voltages of the pixel and the corresponding compensation voltages, and further providing the corresponding data voltages to the pixels via the data lines.

9. The pixel driving method of claim 7, wherein a fourth transistor is arranged between second ends of the light emitting units of each two rows of the pixels, and configured to electrically connect or disconnect the second ends of the light emitting units of the two rows of the pixels, the driving method further comprises:

before reading the voltage levels of the gate ends of the second transistors, turning off the fourth transistor electrically connected between the second ends of the light emitting units of the two rows of the pixels, and after reading the voltage levels of the gate ends of the second transistors, turning on the fourth transistor electrically connected between the second ends of the light emitting units of the two rows of the pixels.

10. The pixel driving method of claim 7, wherein a fifth transistor is arranged between the first ends of the second transistors of each column of the pixels and a corresponding data line, and configured to electrically connect or disconnect the first ends of the second transistors of the column of the pixels with the corresponding data line, the driving method further comprises:

before reading the voltage levels of the gate ends of the second transistors, turning on the fifth transistor electrically connected between the first ends of the second transistors of the column of the pixels and the corresponding data line, and after reading the voltage levels of the gate ends of the second transistors, turning off the fifth transistor electrically connected between the first ends of the second transistors of the column of the pixels and the corresponding data line.

11. The pixel driving method of claim 7, wherein a sixth transistor is arranged between second ends of the light emitting units of each row of the pixels and a corresponding scan line, and configured to electrically connect or disconnect the second ends of the light emitting units of the row of the pixels with the corresponding scan line, the driving method further comprises:

before reading the voltage levels of the gate ends of the second transistors, turning on the sixth transistor electrically connected between the second ends of the light emitting units of the row of the pixels and the corresponding scan line, and after reading the voltage levels of the gate ends of the second transistors, turning off the sixth transistor electrically connected between the second ends of the light emitting units of the row of the pixels and the corresponding scan line.

12. The pixel driving method of claim 1, wherein providing the corresponding data voltages to the pixels through the data lines according to the voltage levels of the gate ends of the second transistors comprises:

obtaining corresponding compensation voltages of the pixels according to the voltage levels of the gate ends of the second transistors; and obtaining corresponding data voltages of the pixels by performing operations according to display voltages of the pixel and the corresponding compensation voltages, and further providing the corresponding data voltages to the pixels via the data lines.

13. The pixel driving method of claim 1, wherein a fourth transistor is arranged between second ends of the light emitting units of each two rows of the pixels, and configured to electrically connect or disconnect the second ends of the light emitting units of the two rows of the pixels, the driving method further comprises:

before reading the voltage levels of the gate ends of the second transistors, turning off the fourth transistor electrically connected between the second ends of the light emitting units of the two rows of the pixels, and after reading the voltage levels of the gate ends of the second transistors, turning on the fourth transistor electrically connected between the second ends of the light emitting units of the two rows of the pixels.

14. The pixel driving method of claim 1, wherein a fifth transistor is arranged between the first ends of the second transistors of each column of the pixels and a corresponding data line, and configured to electrically connect or disconnect the first ends of the second transistors of the column of the pixels with the corresponding data line, the driving method further comprises:

before reading the voltage levels of the gate ends of the second transistors, turning on the fifth transistor electrically connected between the first ends of the second transistors of the column of the pixels and the corresponding data line, and after reading the voltage levels of the gate ends of the second transistors, turning off the fifth transistor electrically connected between the first ends of the second transistors of the column of the pixels and the corresponding data line.

15. The pixel driving method of claim 1, wherein a sixth transistor is arranged between second ends of the light emitting units of each row of the pixels and a corresponding scan line, and configured to electrically connect or disconnect the second ends of the light emitting units of the row of the pixels with the corresponding scan line, the driving method further comprises:

before reading the voltage levels of the gate ends of the second transistors, turning on the sixth transistor electrically connected between the second ends of the light emitting units of the row of the pixels and the corresponding scan line, and after reading the voltage levels of the gate ends of the second transistors, turning off the sixth transistor electrically connected between the second ends of the light emitting units of the row of the pixels and the corresponding scan line.

16. A display panel comprising:

a plurality of scan lines;

a plurality of data lines;

a plurality of pixels, each of the pixels comprising:

a first transistor, a first end of the first transistor being coupled to one of the plurality of data lines, a gate end of the first transistor being coupled to one of the plurality of scan lines;

a second transistor, a first end of the second transistor configured to selectively coupled to a voltage source or a current source, a gate end of the second transistor being coupled to a second end of the first transistor; and a light emitting unit, a first end of the light emitting unit being coupled to a second end of the second transistor;

a voltage reading unit, coupled to the plurality of data lines, configured to read voltage levels of the gate ends of the second transistors when the first transistors of the pixels are turned on, and the data lines and the first ends of the second transistors are coupled to the current source;

a display voltage adjusting unit, configured to provide corresponding data voltages to the pixels through the data lines according to the voltage levels of the gate ends of the second transistors, in order to allow the pixels to receive currents from the voltage source according to the corresponding data voltages when the first ends of the second transistors are coupled to the voltage source; and a plurality of third transistors, each of the third transistors being electrically connected between the second transistors of each two columns of the pixels, configured to electrically connecting or disconnecting the first ends of the second transistors of the two columns of the pixels.

17. The display panel of claim 16 further comprising a plurality of fourth transistors, each of the fourth transistors being electrically connected between second ends of the light emitting units of each two rows of the pixels, configured to electrically connect or disconnect the second ends of the light emitting units of the two rows of the pixels.

18. The display panel of claim 17 further comprising a plurality of fifth transistors, each of the fifth transistors being electrically connected between the first ends of the second transistors of each column of the pixels and a corresponding data line, configured to electrically connect or disconnect the first ends of the second transistors of the column of the pixels with the corresponding data line.

19. The display panel of claim 16 further comprising a plurality of fifth transistors, each of the fifth transistors being electrically connected between the first ends of the second transistors of each column of the pixels and a corresponding data line, configured to electrically connect or disconnect the first ends of the second transistors of the column of the pixels with the corresponding data line.

20. The display panel of claim 16 further comprising a plurality of sixth transistors, each of the sixth transistors being electrically connected between the second ends of the light emitting units of each row of the pixels and a corresponding scan line, configured to electrically connect or disconnect the second ends of the light emitting units of the row of the pixels with the corresponding scan line.

* * * * *